US009779597B2

(12) United States Patent
Havens

(10) Patent No.: US 9,779,597 B2
(45) Date of Patent: Oct. 3, 2017

(54) METHOD OF OPERATING A SECURITY SYSTEM WITH DETERRENT CAPABILITY FOR INTIMIDATION AND NEUTRALIZATION

(71) Applicant: Daphne Kay Havens, Cheyenne, WY (US)

(72) Inventor: Daphne Kay Havens, Cheyenne, WY (US)

(73) Assignee: NOVA PRODUCTS, INC., Ponte Vedra Beach, FL (US)

( * ) Notice: Subject to any disclaimer, the term of this patent is extended or adjusted under 35 U.S.C. 154(b) by 173 days.

(21) Appl. No.: 14/796,057

(22) Filed: Jul. 10, 2015

(65) Prior Publication Data

US 2016/0284182 A1 Sep. 29, 2016

Related U.S. Application Data

(60) Provisional application No. 62/023,037, filed on Jul. 10, 2014.

(51) Int. Cl.

| | |
|---|---|
| ***G08B 13/19*** | (2006.01) |
| ***G08B 13/196*** | (2006.01) |
| ***F41H 13/00*** | (2006.01) |
| ***F42B 12/46*** | (2006.01) |
| ***G08B 15/00*** | (2006.01) |

(52) U.S. Cl.
CPC ... *G08B 13/19682* (2013.01); *F41H 13/0018* (2013.01); *F42B 12/46* (2013.01); *G08B 15/005* (2013.01)

(58) Field of Classification Search
None
See application file for complete search history.

(56) References Cited

U.S. PATENT DOCUMENTS

2002/0101313 A1* 8/2002 Dirnberger ..... A47L 15/4259 335/220
2003/0071743 A1* 4/2003 Seah ..... B64C 1/1469 340/945
2015/0117619 A1* 4/2015 Carpenter ..... H04M 3/5116 379/39

* cited by examiner

*Primary Examiner* — Eileen Adams

(57) ABSTRACT

A method of operating a security system with deterrent capability is implemented through security cameras that are articulated and non-articulated, entry doors, and a control unit. The control unit is communicatively coupled with the security cameras and the entry doors as the control unit is supervised by a trained operator. The security cameras continuously send audio and video data to the control unit so that a threatening target can be identified before he or she can do any destruction. When the threatening target is identified, the entry doors are locked and electrified through the control unit in order to provide an initial defense system for the threatening target. Additional deterrence can be implemented at the threatening target through a less-lethal deterrence unit and non-lethal deterrence units of the articulated security cameras while the non-articulated security cameras provide surveillance of the threatening target to the control unit.

6 Claims, 8 Drawing Sheets

METHOD OF OPERATING A SECURITY SYSTEM WITH DETERRENT CAPABILITY FOR INTIMIDATION AND NEUTRALIZATION

The current application claims a priority to the U.S. Provisional Patent application Ser. No. 62/023,037 filed on Jul. 10, 2014.

FIELD OF THE INVENTION

This invention is for an advanced security and/or surveillance system that provides capabilities to deter or neutralize a suspicious target through a non-lethal deterrence unit and a lethal deterrence unit in addition to the normal surveillance and detection capabilities seen in existing surveillance systems.

BACKGROUND OF THE INVENTION

Current security/surveillance systems observe a specific area primarily through the use of video displays that are connected to cameras that allow observance of the area using visible or infrared radiation. Existing security/surveillance systems are limited to the detection and observance of an area to detect any potential intruders or assailants. However, the existing surveillance systems is not able to provide any real time response against a suspicious target. For example, the existing surveillance systems are designed to observe and detect any suspicious activities, wherein advance systems are able to notify the emergency dispatch center when necessary. However, all of these existing surveillance systems are not able to defend against or slow down a suspicious target until the emergency personals arrive to the incident site.

It is an objective of the present invention to offer a system with not only the ability to observe and detect a suspicious target that can be an intruder or assailant, but also to deter or immobilize the suspicious target through the use of intimidation and/or the use of less lethal means of neutralization. Intimidation and neutralization can be achieved in a number of ways, which would include, but is not limited to, a laser beams that would imply a potential attack from the intruder's viewpoint, usage of flashing lights and warning sirens, usage of less lethal projectiles that are commonly used by weapons used as a less lethal means of force by law enforcement and military personnel. If intimidation is not sufficient and less lethal means of neutralization would normally be applied with this security/surveillance system for civilian use, but advanced nonlethal or lethal force can be used for military and law enforcement applications.

DETAIL DESCRIPTIONS OF THE INVENTION

All illustrations of the drawings are for the purpose of describing selected versions of the present invention and are not intended to limit the scope of the present invention.

The present invention is a method of operating a security system that utilizes deterrent capability to intimidate or neutralize a threatening target. The deterrent capability of the present invention uses non-lethal forces and/or less-lethal force in order to successfully intimate or neutralize the threatening target. As a result, the present invention is able to defend against the threatening target while assuring the safety of the innocent people. The present invention is implemented through the security system that includes a plurality of security cameras, a plurality of entry doors, and a control unit. In reference to FIG. 1, the control unit is communicatively coupled with the plurality of entry doors and the plurality of security cameras that includes at least one articulated security camera and at least one non-articulated security camera. The control unit functions as the command center and is able to monitor and operate the plurality of security cameras and the plurality of entry doors through a graphic user interface (GUI) of the control unit. The communicative connection from the control unit to the plurality of security cameras and the plurality of entry doors can be a wireless connection or a wired connection, wherein one does not precede the other. However, a trained operator oversees the control unit in order to deliver real time response against the threatening target.

Figure 2:
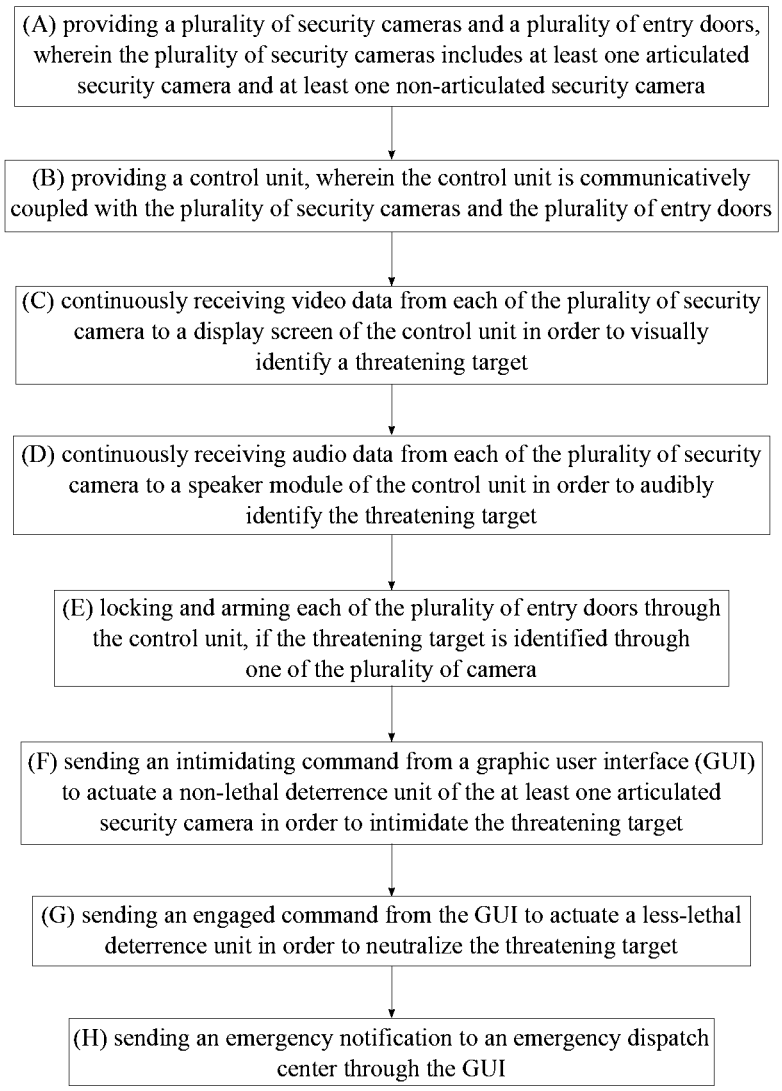
FIG. 2 is a flow chart illustrating the basic overall method of the present invention.
Figure 3:
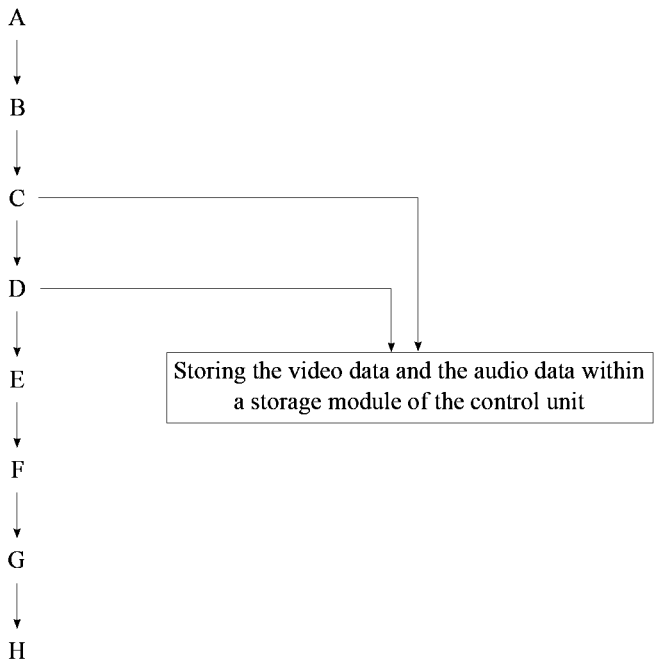
FIG. 3 is a flow chart illustrating the storing of the video and audio data within the overall method of the present invention.

In reference to FIG. 2-3, when the security system is operational, the plurality of security camera continuously sends video data and audio data to the control unit. Once control unit receives the video data and the audio data, the video data from each of the plurality of security camera is displayed on a display screen of the control unit while the audio data from each of the plurality of security camera is emitted through a speaker module of the control unit. Additionally, the video data and the audio data are stored within a storage module of the control unit so that the stored data can be later used by the law enforcement personals as the evidence. The display screen may consist of an array of monitors in such a way that the plurality of security cameras supplies the video data of a secured area to the monitors. The display screen is able to display a zoom-in video feed, multiple video feed of the threatening target, and multiple video feed of a specific camera as each different function is activated through the GUI. Since the audio data and the video data are delivered through the control unit, the threatening target within the parameters of the security system can be easily identified through the present invention.

The at least one non-articulated security camera and the at least one articulated security camera are able to detect the threatening target through visible radiation, Infrared radiation, or through the activation of a sensor that normally senses movement, the breaking of a line of light of radiation or the sudden change in the incoming radiation to the sensor. More specifically, the at least one non-articulated security camera is mainly utilized as the surveillance camera to detect and follow the threatening target within the security system. However, the at least one articulated security camera is utilized to detect, follow, and defend against the threatening target. The positioning and pointing of the plurality of security cameras is optimized based upon the particular geometry of a building and upon assumptions concerning that the movement of the assailant may gain entry to the building. For example, the at least one non-articulated security camera would view the exterior and entrance areas of a building and would be located throughout the building hallways, common areas, and rooms; the at least one articulated security camera may be hidden or disguised and strategically placed throughout the building. The at least one articulated security camera is able to defend against the threatening target through a non-lethal deterrence unit and a less-lethal deterrence unit as each of the deterrence units is equipped with different preventive capability. More specifically, the main objective of the non-lethal deterrence unit and the less-lethal deterrence unit are to discourage an actual threat or make a potential threat leave the secured area.

Figure 1:
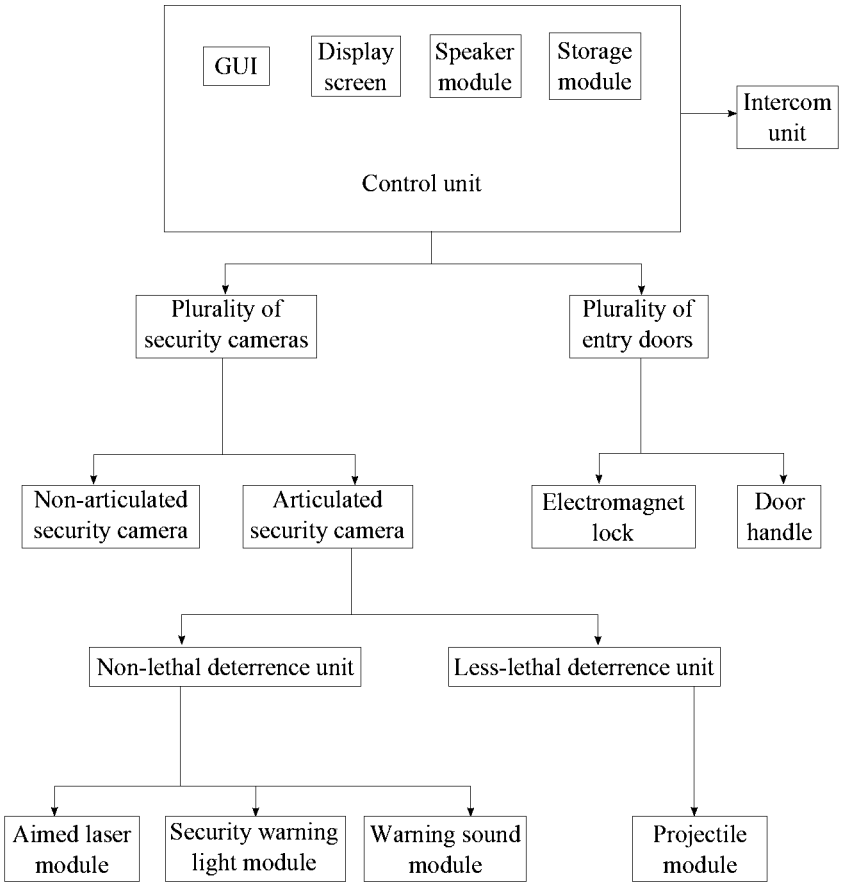
FIG. 1 is a basic illustration showing the components of the security system of the present invention.

In reference to FIG. 1, the non-lethal deterrence unit of the present invention preferably comprises an aimed laser module, a security warning light module, and a warning sound module. However, the present invention can include any other types of non-lethal deterrence units within the at least one articulated security camera as long as the non-lethal deterrence units are able to intimidate the threatening target. The less-lethal deterrence unit of the present invention comprises a projectile module, preferably a pepper-ball launcher. However, the present invention can include any other type of projectile modules, such as rubber bullets and electrically charged projectiles, within the at least one articulated security camera as long as the less-lethal deterrence unit is able to neutralize the threatening target. In reference to advance military and law enforcement application, the less-lethal deterrence unit of the present invention can utilize lethal projectile against the threatening target where the use of lethal force need to be escalated.

In order for the present invention to efficiently function, the at least one articulated security camera and the at least one non-articulated security camera are strategically placed around the secured area so that the threatening target can be tracked and monitored without any blind spots. Additionally, the strategic placement of the at least one articulated security camera enables proper utilization of the less-lethal deterrence unit and the non-lethal deterrence unit when necessary.

Figure 4:
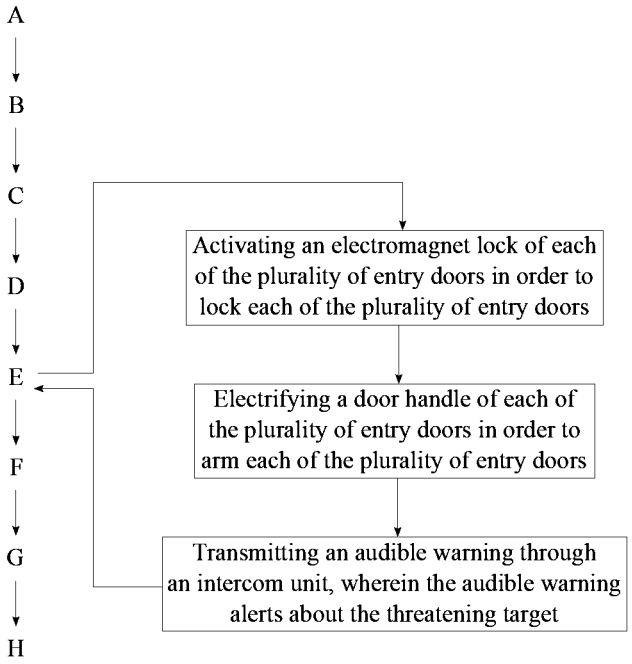
FIG. 4 is a flow chart illustrating the locking and arming of the entry doors within the overall method of the present invention.

In reference to FIG. 2 and FIG. 4, when the threatening target is identified through one of the plurality of camera, each of the plurality of entry doors is locked and armed through the control unit. Each of the plurality of entry doors comprises an electromagnetic lock and a door handle as the electromagnetic lock and the door handle individually provide an important functionality to the present invention. More specifically, each of the plurality of entry doors is locked through the electromagnetic lock as the GUI is able to selectively activate the electromagnetic lock. For example, the GUI can simultaneously lock all of the entry doors to provide a complete lock-down for the secured area or individually and selectively lock some of the entry doors to provide a partial lock-down for the secured area. As a result, each of the plurality of entry doors is able to individually function as a barrier for the threatening target where the electromagnetic lock prevents entry to the secured area through the plurality of entry doors. Similarly, each of the plurality of entry doors is armed through the door handle as the GUI is able to selectively electrify the door handle in such a way that door handle functions as a defense mechanism for the threatening target. As a result of the electrified door handle, each of the plurality of entry doors can be armed to slow down the threatening target. For example, if the threatening target tries to open the one of the plurality of entry doors through the door handle, he/she gets electrify upon touching the electrified door handle. Simultaneously, the control unit transmits an audible warning through an intercom unit to alert about the threatening target so that personals within the secured area can be informed about the threatening target.

The control unit fully interacts with the plurality of entry doors, the at least one articulated security camera, and the at least one non-articulated camera so that surveillance and security features of the present invention can be optimized. The GUI can be operated via touch screen controls, joysticks, and other common means of remotely controlling devices that are accessible from a remote location or via the communication system in place that allows operation from cell phones, portable computers, etc.

Figure 5:
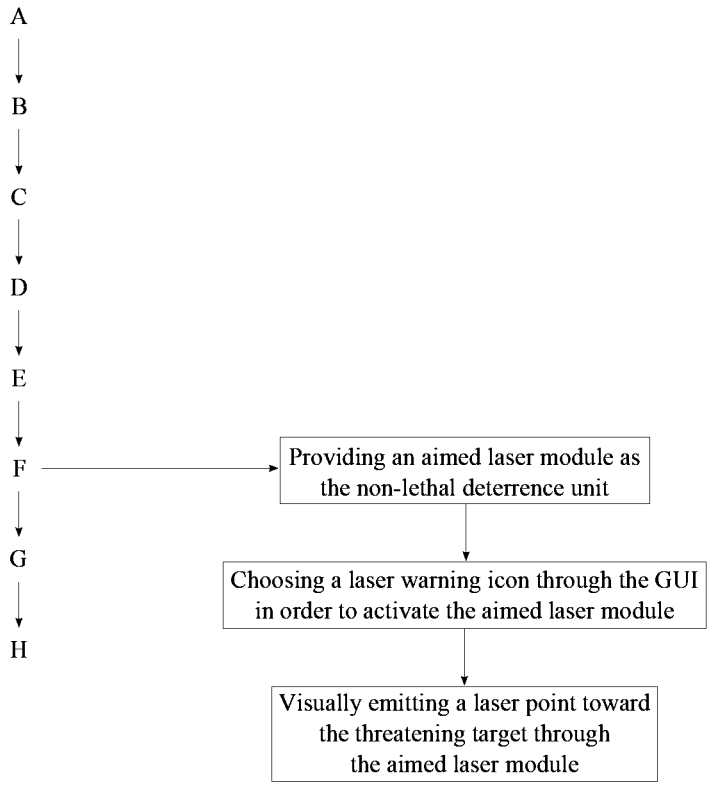
FIG. 5 is a flow chart illustrating the operation of the aimed laser module within the overall method of the present invention.
Figure 6:
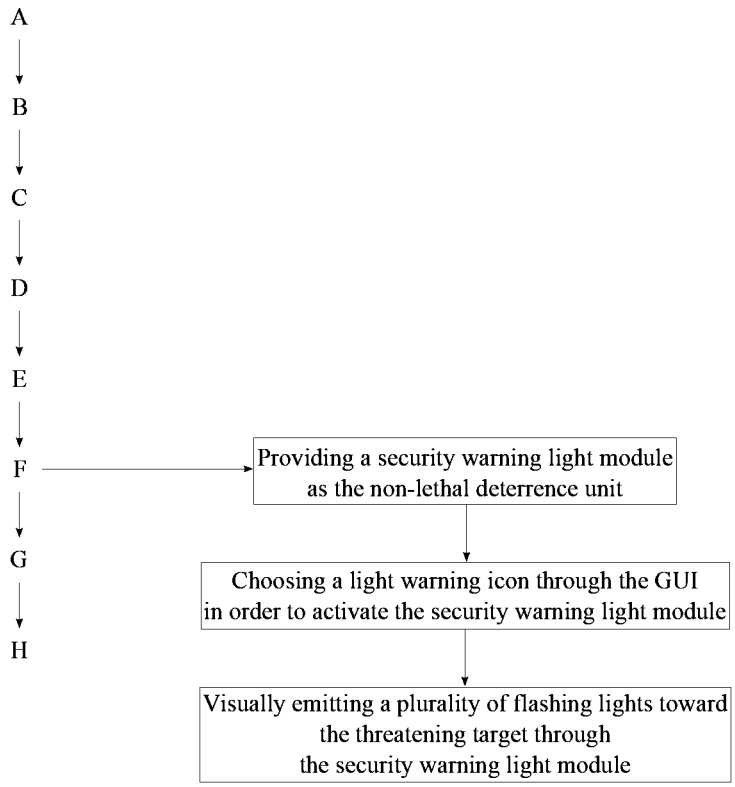
FIG. 6 is a flow chart illustrating the operation of the security warning light module within the overall method of the present invention.
Figure 7:
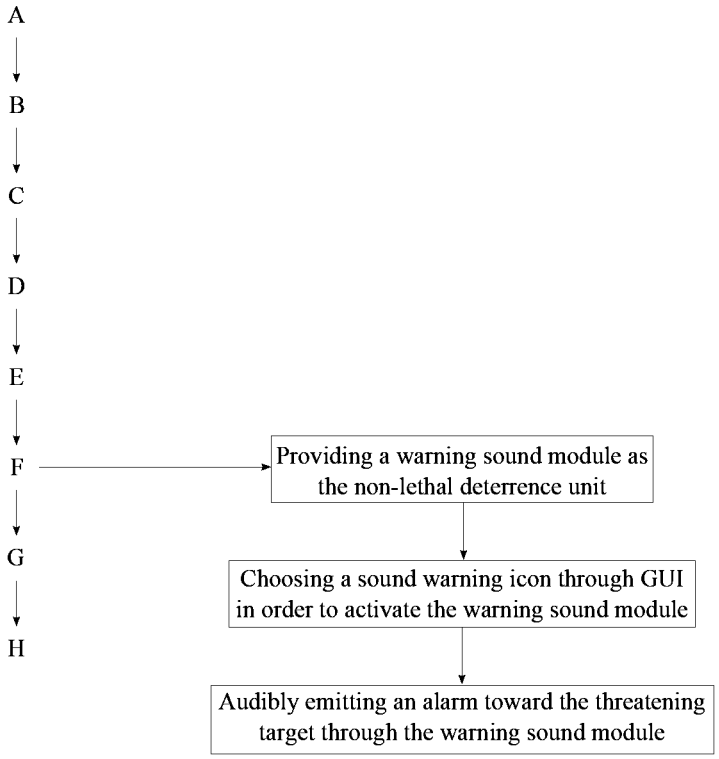
FIG. 7 is a flow chart illustrating the operation of the warning sound module within the overall method of the present invention.

In the event that the plurality of entry doors is not effective or not relevant against the threatening target, the control unit is able to intimidate the threatening target through the non-lethal deterrence unit as illustrated in FIG. 2. More specifically, an intimidating command is sent from the GUI to actuate the non-lethal deterrence unit. Since the non-lethal deterrence unit of the present invention preferably comprises the aimed laser module, the security warning light, and the warning sound module, the control unit is able to selectively or mutually activate the aimed laser module, the security warning light, and the warning sound module to intimidate the threatening target. In reference to FIG. 5, when a laser warning icon is chosen through the GUI, the aimed laser module within the present invention is activated through the GUI as the non-lethal deterrence unit. Then a laser point from the aimed laser module is visually emitted from the aimed laser module in the direction of the threatening target. The main assumption behind the laser point is to convince the threatening target that a hidden firearm is going to be engaged with the threatening target so that he or she may consider leaving the secured area without creating any destruction. In reference to FIG. 6, when a light warning icon is chosen through the GUI, the security warning light module within the present invention is activated through the GUI as the non-lethal deterrence unit. Then a plurality of flashing lights from the security warning light module is visually emitted in the direction of the threatening target. The main assumption behind the plurality of flashing lights is to temporally blind the threatening target. The temporary blindness of the threatening target may assist law enforcement agents to takedown the threatening target or may cause the threatening target to leave the secured area. In reference to FIG. 7, when a sound warning icon is chosen through the GUI, the warning sound module within the present invention is activated through the GUI as the non-lethal deterrence unit. Then an alarm from the warning sound module is audibly emitted in the direction of the threatening target to scare and intimidate the threatening target.

Figure 8:
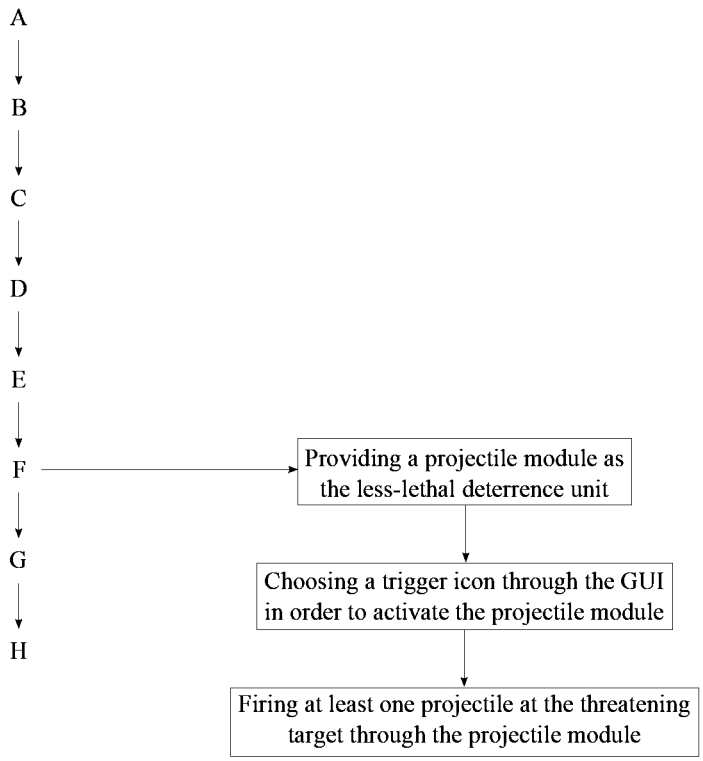
FIG. 8 is a flow chart illustrating the operation of the projectile module within the overall method of the present invention.

In the event that the plurality of entry doors and the non-lethal deterrence unit are not effective against the threatening target, the control unit is able to neutralize the threatening target through the less-lethal deterrence unit as illustrated in FIG. 2. More specifically, an engaged command is sent from the GUI to actuate the less-lethal deterrence unit. Since the less-lethal deterrence unit of the present invention preferably comprises the pepper-ball launcher as the projectile module, the control unit is able to activate the pepper-ball launcher through a trigger icon of the GUI. In reference to FIG. 8, when the trigger icon is chosen, the projectile module within the present invention is activated through the GUI as the less-lethal deterrence unit. Then at least one projectile is fired at the threatening target to neutralize the threatening target as the number of projectiles fired at the threatening target can be pre-programed within the present invention. Once the non-lethal deterrence unit and/or the less-lethal deterrence unit is activated, the GUI can also send out an emergency notification to an emergency dispatch center so that the first responders can be notified.

The present invention can be apply to protect civilian population in any environment where security/surveillance is needed, such as public building security/surveillance, outside areas that need to be protected because of property or potential crime, home security/surveillance systems, and law enforcement and military applications. For example, schools have become an easy target for a threatening person to kill or harm innocent victims in an environment where there is no resistance. If a threatening person is detected, there is usually no means of deterring the threat because personals and equipment required for defense are not normally in the school environment because of safety concerns associated with the presence of conventional weapons. However, due to the placement of the security system of the present invention, the school environment can be protected against the threatening person. Then the less-lethal deterrence unit and the non-lethal deterrence unit are able to use minimal and less lethal force that do not cause permanent harm to the threatening person. As a result, the present invention provides a means of taking action immediately against the threatening person without the threat of killing innocent citizens.

Although the invention has been explained in relation to its preferred embodiment, it is to be understood that many other possible modifications and variations can be made without departing from the spirit and scope of the invention as hereinafter claimed.

What is claimed is:

1. A method of operating a security system with deterrent capability for intimidation and neutralization comprises the steps of:

(A) providing a plurality of security cameras and a plurality of entry doors, wherein the plurality of security cameras includes at least one articulated security camera and at least one non-articulated security camera;

(B) providing a control unit, wherein the control unit is communicatively coupled with the plurality of security cameras and the plurality of entry doors;

(C) continuously receiving video data from each of the plurality of security camera to a display screen of the control unit in order to visually identify a threatening target;

(D) continuously receiving audio data from each of the plurality of security camera to a speaker module of the control unit in order to audibly identify the threatening target;

(E) locking and arming each of the plurality of entry doors through the control unit, if the threatening target is identified through one of the plurality of camera;

(F) sending an intimidating command from a graphic user interface (GUI) to actuate a non-lethal deterrence unit of the at least one articulated security camera in order to intimidate the threatening target;

(G) sending an engaged command from the GUI to actuate a less-lethal deterrence unit in order to neutralize the threatening target, providing a projectile module as the less-lethal deterrence unit, choosing a trigger icon through the GUI in order to activate the projectile module, and firing at least one projectile at the threatening target through the projectile module; and (H) sending an emergency notification to an emergency dispatch center through the GUI.

2. The method of operating a security system with deterrent capability for intimidation and neutralization as claimed in claim 1 comprises the steps of:

storing the video data and the audio data within a storage module of the control unit.

3. The method of operating a security system with deterrent capability for intimidation and neutralization as claimed in claim 1 comprises the steps of:

activating an electromagnet lock of each of the plurality of entry doors in order to lock each of the plurality of entry doors;

electrifying a door handle of each of the plurality of entry doors in order to arm each of the plurality of entry doors; and transmitting an audible warning through an intercom unit, wherein the audible warning alerts about the threatening target.

4. The method of operating a security system with deterrent capability for intimidation and neutralization as claimed in claim 1 comprises the steps of:

providing an aimed laser module as the non-lethal deterrence unit;

choosing a laser warning icon through the GUI in order to activate the aimed laser module; and visually emitting a laser point toward the threatening target through the aimed laser module.

5. The method of operating a security system with deterrent capability for intimidation and neutralization as claimed in claim 1 comprises the steps of:

providing a security warning light module as the non-lethal deterrence unit;

choosing a light warning icon through the GUI in order to activate the security warning light module; and visually emitting a plurality of flashing lights toward the threatening target through the security warning light module.

6. The method of operating a security system with deterrent capability for intimidation and neutralization as claimed in claim 1 comprises the steps of:

providing a warning sound module as the non-lethal deterrence unit;

choosing a sound warning icon through GUI in order to activate the warning sound module; and audibly emitting an alarm toward the threatening target through the warning sound module.

* * * * *